US006499840B2

(12) United States Patent
Day et al.

(10) Patent No.: US 6,499,840 B2
(45) Date of Patent: Dec. 31, 2002

(54) MULTI-FUNCTIONAL PRINTER

(75) Inventors: Robert Charles Lewis Day, Hertfordshire (GB); Jonathan Kemp, Cambridge (GB); Adrian Michael Woodward, Hertfordshire (GB); Lawrence Archard, Cambridge (GB); Robert Charles Sims, Hertfordshire (GB); Geert Heyse, Sint Katelijne Waver (BE); Michel Woodman, Cambridgeshire (GB); Chris McCleave, London (GB); Martin Gibbs, East Sussex (GB)

(73) Assignee: Esselte N.V., Sint-Niklaas (BE)

( * ) Notice: Subject to any disclaimer, the term of this patent is extended or adjusted under 35 U.S.C. 154(b) by 0 days.

(21) Appl. No.: 09/853,627

(22) Filed: May 14, 2001

(65) Prior Publication Data

US 2002/0018108 A1 Feb. 14, 2002

Related U.S. Application Data

(63) Continuation of application No. PCT/GB99/03544, filed on Oct. 26, 1999.

(30) Foreign Application Priority Data

Nov. 13, 1998 (GB) ..... 9825021

(51) Int. Cl.[7] ..... B41J 2/01
(52) U.S. Cl. ..... 347/100; 347/108; 346/24
(58) Field of Search ..... 347/100, 108, 347/101; 346/24

(56) References Cited

U.S. PATENT DOCUMENTS

| | | | | |
|---|---|---|---|---|
| 4,436,439 A | 3/1984 | Koto | ..... | 400/126 |
| 5,063,451 A | 11/1991 | Yanagisawa et al. | ..... | 346/143 |
| 5,093,147 A | 3/1992 | Andrus et al. | ..... | 427/7 |

(List continued on next page.)

FOREIGN PATENT DOCUMENTS

| | | | | |
|---|---|---|---|---|
| EP | 0 003 187 | 7/1979 | ..... | G09F/3/02 |
| EP | 0 598 251 A1 | 5/1994 | ..... | B41K/1/14 |
| EP | 0 632 398 A2 | 1/1995 | | |
| FR | 2 717 938 | 9/1995 | ..... | G09F/3/02 |
| GB | 2 243 578 A | 11/1991 | ..... | G09F/3/02 |
| JP | 79-050339 B | 12/1978 | | |
| JP | 60161166 | 8/1985 | | |
| JP | 89-197132 | 5/1989 | | |
| WO | WO 92/16375 | 10/1992 | ..... | B41J/3/28 |
| WO | WO 97/10307 | 3/1997 | ..... | C09O/11/00 |

OTHER PUBLICATIONS

PCT International Preliminary Examination Report, PCT/GB99/03544, dated Feb. 6, 2001.
PCT International Search Report, PCT/GB89/03544, dated May 19, 2000.

*Primary Examiner*—John Barlow
*Assistant Examiner*—Manish S. Shah
(74) *Attorney, Agent, or Firm*—Pennie & Edmonds LLP

(57) ABSTRACT

The invention relates to a printer including a scanning mechanism provided in a housing, a mounting mechanism for releasably mounting a print head to the scanning mechanism, and an aperture. The scanning mechanism is arranged to move within the housing. The aperture is provided within the housing and arranged to be placed on, or adjacent to, an image receiving medium such that the print head, when mounted, is operable to print onto the image receiving medium through the aperture. In order to engrave an image into the image receiving medium, it is proposed that the mounting mechanism is arranged to accommodate a holding mechanism which holds a machining device for machining a medium. The printer may be provided with an ink supply containing a security ink, especially for printing entry receipts onto the hand of as customer entering a discotheque, concert, or other event.

21 Claims, 4 Drawing Sheets

U.S. PATENT DOCUMENTS 5,451,759 A 9/1995 Hoshino et al. ..... 235/449
5,554,842 A 9/1996 Connell et al. ..... 235/491
5,569,317 A * 10/1996 Sarada et al. ..... 347/100
5,634,730 A 6/1997 Bobry ..... 400/88
5,660,925 A 8/1997 Cooley et al. ..... 428/304.4
5,685,651 A * 11/1997 Heyman et al. ..... 347/109
5,746,527 A * 5/1998 Nebashi et al. ..... 346/24
5,825,995 A 10/1998 Wiklof et al. ..... 395/117
5,837,042 A 11/1998 Lent et al. ..... 106/31.14
5,944,881 A * 8/1999 Mehta et al. ..... 106/31.28

* cited by examiner

MULTI-FUNCTIONAL PRINTER

CROSS-REFERENCE TO RELATED APPLICATIONS

This application is a continuation of copending International Application No. PCT/GB99/03544, filed Oct. 26, 1999.

FIELD OF THE INVENTION

The present invention relates to a multi-functional printer.

BACKGROUND OF THE INVENTION

In the state of the art, a number of printers capable of "direct" printing are known. Direct printing in the context of the present invention means that the printer is placed on the image receiving medium, usually manually, and the printing means of the printer or the entire printer then scans over the image receiving medium in the printing operation. Thus, the medium is not fed through the printer—as in most office printers—but the printer moves over the medium.

Such a printer is known from ER 564297 A. The printer is manually positioned on an image receiving medium and has an ink jet print head which scans in two orthogonal directions over the image receiving medium. The printer is connected to a computer and capable, for example, of printing addresses onto envelopes, but can also be used separately from the computer for printing data downloaded from the computer to the printer.

Another ink jet printer that is placed on a printing medium is disclosed in U.S. Pat. No. 5,634,730. This printer is provided with a keyboard for inputting data, but can also print images downloaded from a computer. The print head scans over the image receiving medium along a special path, e.g., helically or like a pendulum.

DE 3142937 A refers to a so-called hand stamp which is placed manually on the image receiving medium. It can print data downloaded from an accounting machine, or images consisting of user-selected fixed phrases. The hand stamp has a thermal print head and an ink ribbon for printing.

The direct printers known in the prior art are thus capable of printing an image onto an image receiving medium, and make use of a scanning print head. Thus, they can only perform one function, which is printing. On the other hand, a number of purposes for a scanning device can be imagined, for which such a device could be used, as well.

Thus, the object of the present invention is to provide a printer of the type having a scanning print head, which allows for use of the printer for printing and for purposes different than printing.

SUMMARY OF THE INVENTION

According to the invention, there is provided a printer having a housing and a scanning means provided in the housing. The scanning means is arranged to move in two different directions within the housing. The printer also includes a mounting means for releasably mounting a print head to the scanning means, and an aperture provided within the housing. The aperture is arranged to be placed on, or adjacent to, a medium such that the print head, when mounted, is operable to print onto the medium through the aperture. The mounting means is arranged to accommodate a holding means which holds a machining device for machining the medium.

The proposed solution is to use the mounting means for fixing a holding unit to the scanning means instead of, or in addition, to the print head being fixed to the scanning means. The holding unit holds a machining device for machining the image receiving medium. Thus, the printer can be used for printing, when the print head is mounted to the mounting means, and alternatively or additionally, for machining a medium on which it is mounted. The scanning means then moves the machining device over the medium which is being machined.

An advantage of the invention is that the printer is not only suitable for printing, but can be used for another purpose, as well. This second purpose is to machine a medium.

In particular, the machining device can be a cutting blade, a rotating milling cutter, or a rotating drill. Since these tools normally have to be rotated when the medium is machined, the printer, or more particularly, the holding means which can be released from the printer and holds the machining device, is provided with rotating means for rotating the machining device with respect to the machined medium. In particular, the holding means can be provided with a motor for rotating the machining device, whereby the motor is electrically connected to a controlling unit of the printer via a connector which is normally connected to the print head of the printer. Thus, the electrical connection for the print head also serves for providing the motor of the holding means with electrical power. The machining device is preferably releasably connected to the holding means.

The medium which is machined by the machining device is preferably a stencil. Thus, the user can place the printer—to which the machining device is mounted—upon a blank stencil material, and, by machining, engrave a desired image or pattern into the stencil material. This machined material can then be mounted onto a stamp apparatus. It should be noticed that instead of a stencil material, also other materials can be machined. For example, glass or metal plates could be engraved.

The machining device is held by the holding means, which is accommodated in the mounting means instead of the print head—or, in another embodiment of the invention, additionally to the print head.

According to a second aspect of the invention, there is provided a printer having a housing, a scanning means, a mounting means, and an aperture. The scanning means is provided in the housing and arranged to move within the housing. The mounting means mounts an ink jet print head provided with an ink supply to the scanning means. The aperture is provided within the housing and arranged to be placed on, or adjacent to, an image receiving medium such that the print head, when mounted, is operable to print onto the image receiving medium through the aperture. The ink supply preferably contain a security ink.

Additionally, there is provided a method of printing security images onto an image receiving medium, including the steps of providing a printer with a housing and a scanning means in the housing, mounting an ink jet print head provided with an ink supply containing security ink to the scanning means, providing an aperture within the housing, placing the aperture on, or adjacent to, the image receiving medium such that the print head can print onto the image receiving medium through the aperture, and scanning the print head with the scanning means within the housing and thereby spitting the security ink according to a desired pattern onto the image receiving medium.

In the prior art, it is known to use normal rubber stamps for providing entry receipts onto the hand or forearm of a visitor of a concert event, discotheque, or other event. Such rubber stamps can be used in combination with security inks, which, for example, are only visible when illuminated with ultraviolet light. A disadvantage of the prior art is that the rubber stamps are easily counterfeited, while the security ink can be easily obtained in the market. Thus, the security of these entry receipts is quite low.

The second aspect of the invention proposes to replace the rubber stamps with a direct printer, i.e., a printer with an ink jet head scanning over the image receiving medium and spitting a security ink onto the medium, according to a desired pattern. Thus, the security, for example, of entry receipts printed onto the hand or forearm of a user is significantly improved, since the printed image can be altered electronically, and thus with a high frequency (as for example daily), such that it will hardly be possible to make a rubber stamp copy of it before the user of the printer has already chosen a new pattern to be printed as an entry receipt. Furthermore, the printing resolution will normally be much better than any details which can be produced with a rubber stamp.

The security ink is preferably provided in a special ink cartridge. The cartridge can contain the printing nozzles, or be connected to a separate printing unit having nozzles.

Further, the security ink can be of any number of types. One such type is chemical marker ink, i.e., invisible ink which can be made visible by means of a pencil containing a developer liquid, as disclosed in DE 19646156 A, U.S. Pat. No. 5,660,925, or U.S. Pat. No. 5,534,587, the contents of which are incorporated herein by reference. Another type of security ink is ink containing a luminescent substance, which transmits light with a different wavelength compared with the wavelength of the light which the ink is illuminated, as disclosed in EP 680411 A, the contents of are incorporated herein by reference. Another type of security ink is UV fluorescent ink, which fluoresces under UV light, as disclosed in ER 730250 A, ER 267215 A, or EP 3187 A, the contents of which are incorporated herein by reference. Yet another type of security ink that can be used with the present invention is magnetic ink, which contains magnetic particles, which can be detected by means of a special detector making use of polarization of light provided by the magnetic particles, as disclosed in ER 632398 A, the contents of which is incorporated herein by reference. Another type of security ink is phosphorescent ink, which still phosphoresces after it has been illuminated, as disclosed in ER 770969 A or ER 766198 A, the contents of which are incorporated herein by reference. Another type of security ink for use with the present invention are photo chromic inks, which alter their optical appearance under illumination, as disclosed in ER 716387 A, the contents of which is incorporated herein by reference.

BRIEF DESCRIPTION OF THE DRAWINGS

For a better understanding of the present invention and to demonstrate how the same may be carried into effect, reference will now be made to the accompanying drawings in which.

DETAILED DESCRIPTION OF THE PREFERRED EMBODIMENTS

Figure 1:
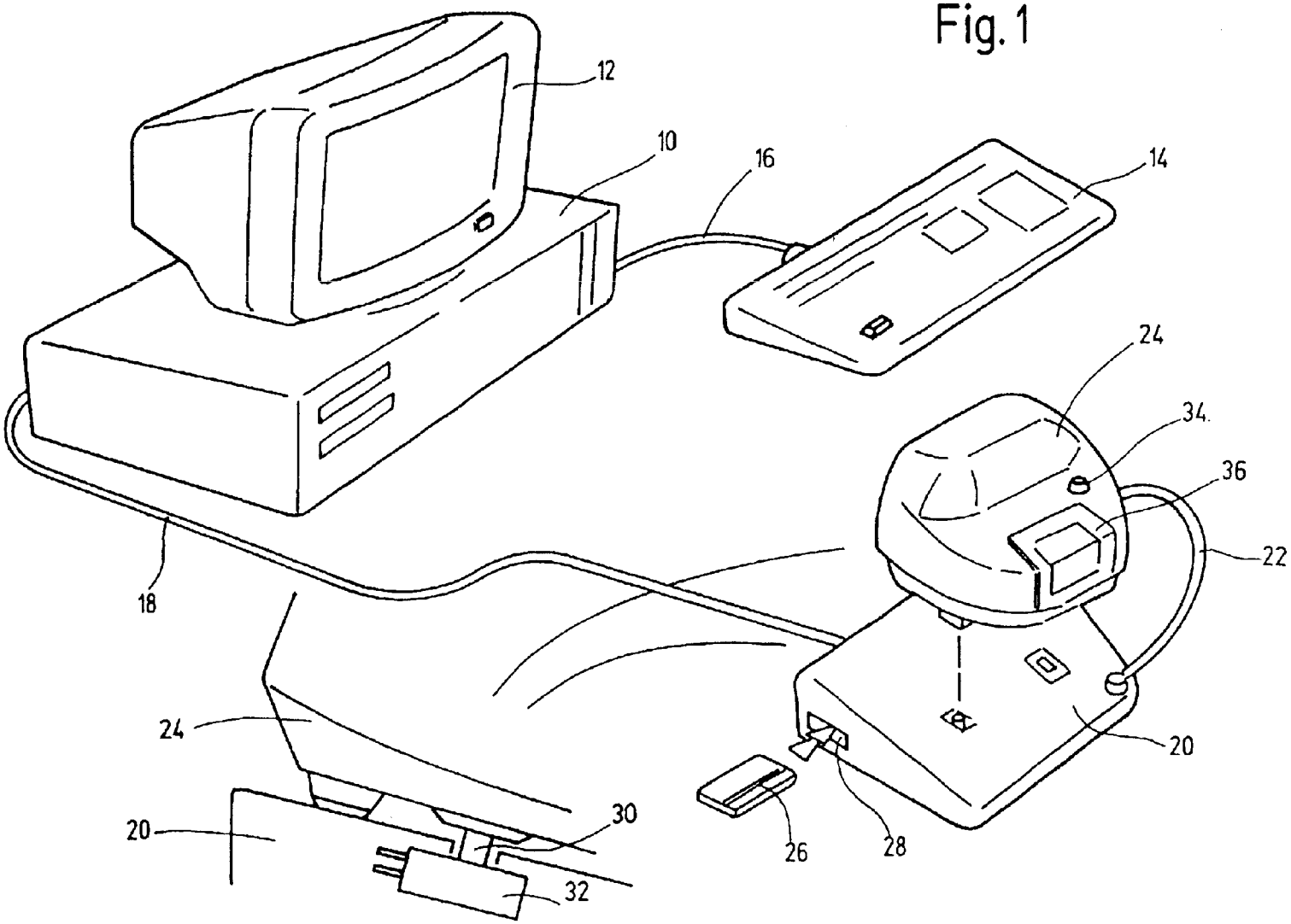
FIG. 1 is a plan view showing a printer, a base station and a computer.

FIG. 1 shows a printing system consisting of a computer 10, a computer controlled display 12, which is in the described embodiment of the invention a CRT, a keyboard 14 linked to the computer 10 by means of a cable 16, and another cable 18, connecting the computer 10 with a base station 20. The base station 20 is connected to a printer 24 by means of a cable 22. Thus, the printer 24 is linked to the computer 10 via the cables 18, 22 and the base station 20.

As known in the prior art, the computer 10 comprises a processor on which software is running, comprising an operating system, a printer driver to enable printing with the printer 24 from the operating system, and a software application by which data can be created, selected and formatted on the PC, for defining image patterns to be printed by the printer 24. The software application can be activated in a number of ways. For instance, the software application can be selected by the user at startup or from the desktop. The user can place the software application in the start up directory or create an icon on the desktop. From within another application, the user may invoke the software application from a button (displayed on the display 12) in the toolbar of another software application. From a handheld printer 24 itself, if the application is not running, the user may press a print button 34 on the hand held printer 24, which will automatically invoke the software application in the first instance.

Another possibility to activate the software application on the computer 10 for controlling the printer 24 is to lift the printer 24 off the base station 20. A switch 32 is provided in the base station 24 sensing the presence or absence of the printer 24 by means of a pin 30. When the printer 24 is placed upon the base station, the pin 30 is depressed, and the switch 32 is closed. In the case that the printer 24 is removed from the base station 20, the pin 30, which is biased in the vertical direction, moves upwardly and the switch 32 opens. The switch is connected via some electronic circuits to the computer 18 and activates the software application for printing.

The base station 20 is connected to the computer 10 by means of the cable 18, which can be a parallel or a USB cable. Electric power is supplied to the base station 20 by a separate mains transformer, but could also be supplied from the computer via the cable 18, preferably when the cable 18 is a USB cable. The cable 18 can be hard wired to the base station 20, or connected to a socket of the base station, which is preferably provided at the rear thereof. When the printer 24 is not in use, the handheld printer may be placed in the base station 20. The base station 20 will ensure that the ink jet print head of the printer 24 is protected when not in use by a capping device that will be automatically triggered whenever the printer is inserted into the base station 20. The base station 20 will also cause the print head of the printer 24 to eject ink into a reservoir and mechanically clean the surface of the print head. These measures are necessary to maintain optimum print quality.

The umbilical cable 22 connects the base station 20 to the hand held printer 24, providing both power and data. An LED on the printer will indicate that power is on. The printer 24 is removed from the base station 24 and positioned on the surface to be printed. The length of the cable 22 limits the distance of travel from the base station.

In another embodiment of the invention, the printer is arranged to be disconnected from the base station by unplugging the umbilical cable 22 and moved to another location where printing of the contents of onboard memory, i.e., downloaded image data, can be effected. The user will employ scroll buttons on the printer to select the required print data, which appear in a small LCD. Once a selection has been made, pressing the print button 34 will activate printing. Having selected the data to print using the software application (or the scroll buttons on the printer), the user will activate printing from the print button 34 on the hand held printer 24 itself.

Print alignment is achieved visually through a transparent window 36 in the printer casing. This window 36 can also be opened for inserting an ink cartridge into the printer 24 before use. The cartridge is then clamped in a carriage of the printer 24. The window 36 must be closed before printing. The user can choose from a range of colored and special inks. Changing a cartridge is achieved by lifting a retaining lever and extracting the cartridge in use and replacing this with a new or different color cartridge in the way described above. If the removed cartridge still contains ink and is to be reused, it must be capped to avoid the ink drying out.

The printer 24 contains a print mechanism with the ink jet print head having a number of print nozzles, and an ink supply. The print head is moved by means of motor driven scanning means within the housing in two (generally orthogonal) directions such that a rectangular area can be imprinted through an aperture of the printer 24 at the bottom of its housing. Thus, the printer 24 is placed manually on an image receiving medium and—when the print button 34 is depressed—the print head scans over the medium and imprints it by spitting ink droplets onto it. The print button has to be held on for a predetermined time, e.g., at least two seconds, to initiate printing (in order to prevent accidental printing).

FIG. 1 shows the printer 24, base station 20 and computer 10 linked by cables. In an embodiment, it is possible to replace one or all of these links by a wireless link such as a low power RF link or an infra red link. FIG. 1 also shows the presence of a "Smart Card" reader 28 in the base station 20. Smart cards 26, i.e., memory cards, may be used for storing data or images or as a substitute for additional RAM in the base station. Spare cards may be stored within the base station where a storage compartment is provided (not shown).

In the case that the printer 24 is powered only by batteries, rather than having the cable 22 transmitting power from the base station 20, the amount of charge remaining in the batteries may be monitored and displayed on a display of the printer 24, and/or on the display 12 of the computer 10. If rechargeable batteries are used, the battery monitoring system could also be used to control the charge/discharge cycle of the battery pack to maximize battery life. This could also enable rapid recharging of the batteries. Such a battery management system could also indicate that there was sufficient energy remaining in the battery pack to complete the current task.

Figure 2:
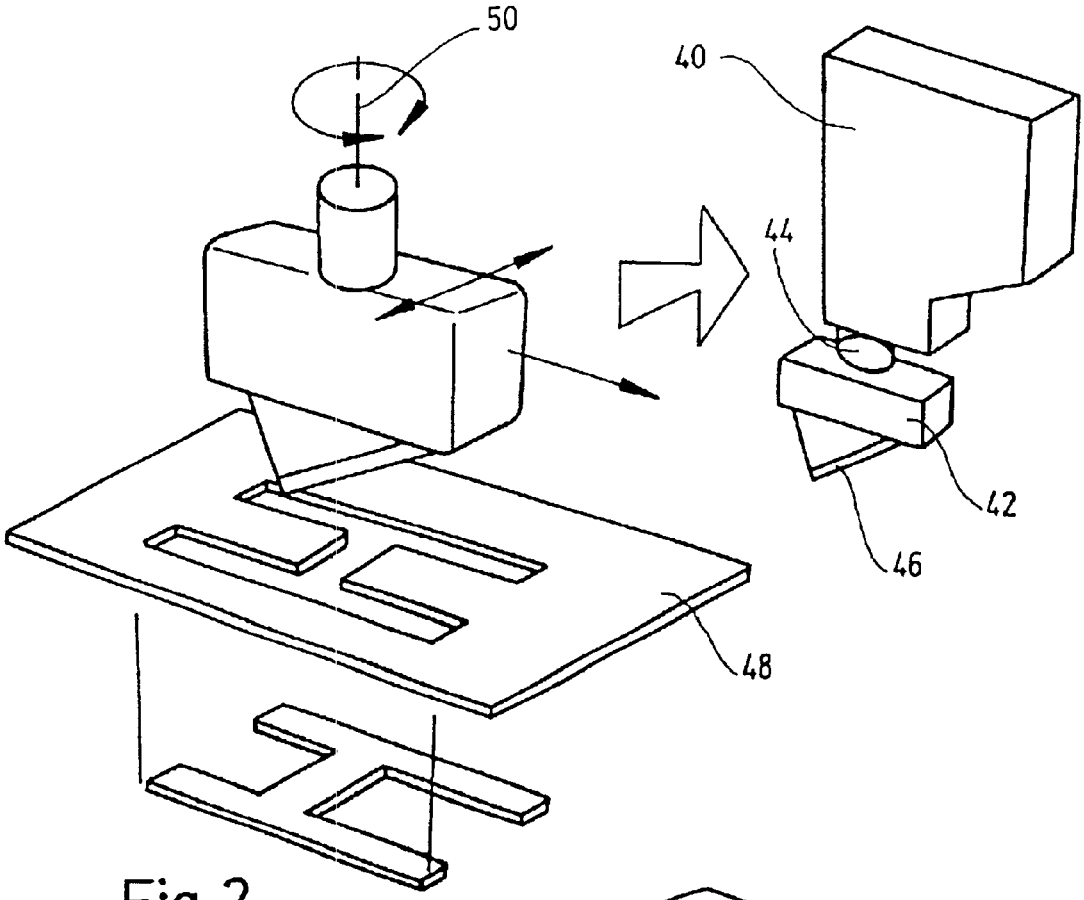
FIG. 2 is a view of a cutter mechanism which is usable instead of the print head of the printer.

As described above, the printer 24 is based on a two dimensional movement of the print head over the image receiving medium. Additional features may be provided to this X-Y motion to perform a range of other functions. For example, the print cartridge could be replaced with a cutter mechanism and then be used for cutting out stencils. This is indicated in FIG. 2. A holder 40 is provided which has the same measurements as an ink jet print head cartridge, such that it can be mounted in the printer 24 instead of a print cartridge. On the bottom of the holder 40, a blade 46 is provided which is mounted to a brick shaped blade holder 42, and the blade holder 42 is connected with the holder 40 via a shaft 44. Since the holder 40 scans in two orthogonal directions over the medium 48, the blade 46 can also be moved over the medium, which is in the embodiment shown in FIG. 2 a stencil material, in order to cut a desired pattern out of it.

Due to the fact that cutting has to be performed along different cutting directions, it is necessary to rotate the cutting blade around an axis 50 lying in a plane defined by the direction of motion of the holder 40. Thus, the blade holder 42 needs to be rotated with respect to the holder 40 around the axis of the shaft 44. This is performed by means of a motor provided in the holder 40. The motor (not shown) is arranged to rotate the shaft 44, via an intermediate gear. The power required by the motor is provided by the printer, via the connections to which the print head is normally connected. Hence, the holder 40 contains a motor connected to the electronics of the printer 24, and controlled by the printer's software. Instead of a blade, a milling cutter or a drill can be mounted to the blade holder 42, among other tools, preferably interchangeable by means of an appropriate releasable connection.

Figure 3:
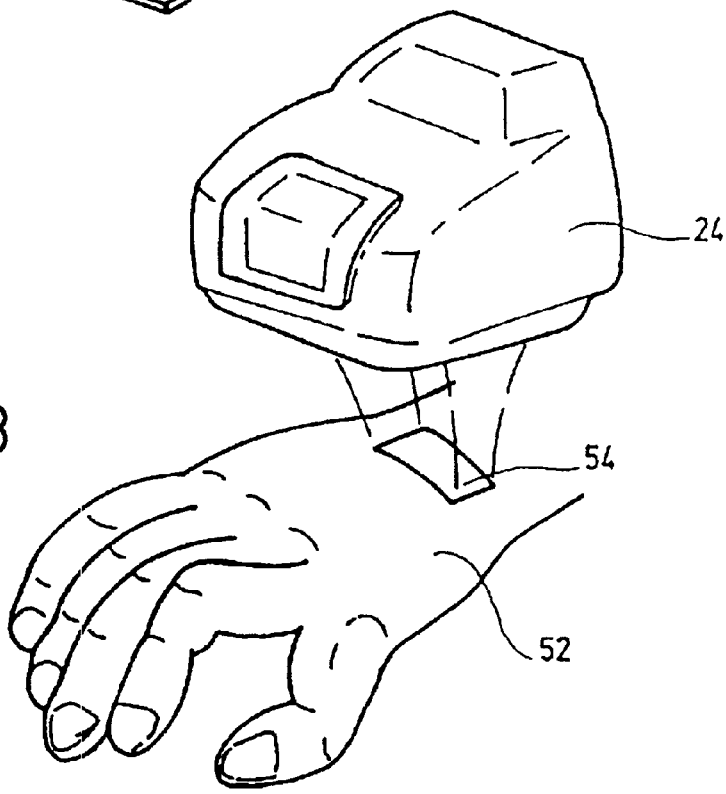
FIG. 3 is a view of a printer using a special security ink.

FIG. 3 illustrates another use of the described printer 24. By insertion of a special ink cartridge, a further use of the printer would be possible. The ink is a security ink, such as a chemical marker ink, an ink containing a luminescent substance, a UV fluorescent ink, a magnetic ink, a phosphorescent ink, or a photo chromic ink. Thus, the printer 24 can be used for printing entry receipts 54 on the backs of the hands 52 of a visitor of a concert, a discotheque, or other events, as shown in FIG. 3.

It should be noted that other possible printing uses include postal franking and printing data onto the reverse of business cards. In this case, the printer would preferably be arranged to remain in the base station and an envelope or a business card is inserted into an appropriate one of a number of molded guides. Typically the user would use a guide which positions an envelope for franking. An appropriate software application would be running on the computer 10, assuring that the postage is paid (e.g., via downloading a franking image from the Internet upon payment via a credit card number), before a franking stamp is printed. The information printed onto the reverse of a business card would have some connection to the person mentioned on the front of this card.

Figure 4:
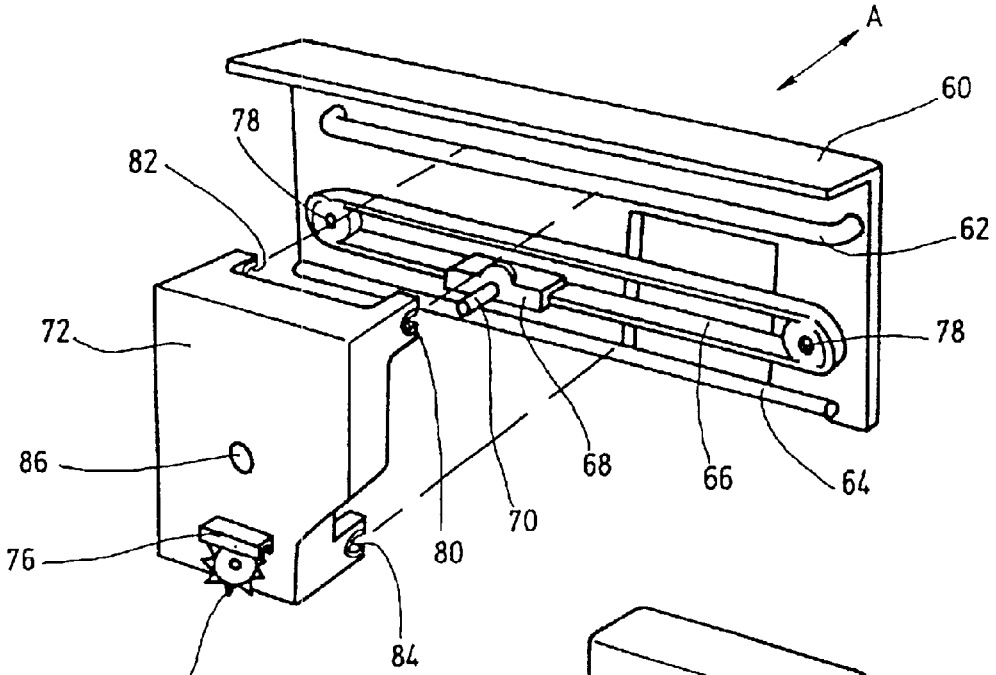
FIG. 4 is a view of a mechanism for fixing the print head in the printer.

FIG. 4 illustrates how a print cartridge 72 is mounted in the printer 24. A metal (or plastic) base plate 60 is mounted for scanning motion along the direction indicated by arrow A. The necessary mechanism for scanning in this direction is not shown in FIG. 4, for the sake of clarity. On the base plate 60, a first guide rail 62 is provided, and a second guide rail 64. Both guide rails 62, 64 extend in a direction which is orthogonal to the direction of movement of the plate 60. Additionally, two wheels 78 are provided, around which a drive belt 66 is located. The drive belt 66 is preferably toothed and extends parallel to the guide rails 62, 64. Further, a pin 70 is provided on a pin holder 68, the latter being fixed to the drive belt 66. The print cartridge 72 is provided with an ink supply and nozzles for spitting the ink onto an image receiving medium. Print cartridge 72 is also provided with four snap-on bearings 80, 82, 84 (the fourth one cannot be seen in FIG. 4—since it is hidden behind the cartridge 72—but is in the same plane as bearing 84 and fits onto guide rail 64). The bearings 80 and 82 are arranged to be snapped (or clipped) into the first guide rail 62, and the bearing 84 plus the hidden bearing are arranged to be snapped into the second guide rail 64. Thus, the cartridge 72 can be slidably fixed to the guide rails 62, 64 and travel along the longitudinal axis of the guide rails. The pin 70 engages in a hole 86 of the cartridge, such that a driving connection between the drive belt 66 and the cartridge 72 is established. When the belt is driven (by means of a corresponding motor, not shown in FIG. 4 for the sake of clarity, but it could drive the belt 66 through the rectangular window in the base plate 60), the cartridge 72 travels along the guide rails 62, 64. In order to control the print head of the cartridge 72, the printer's control electronics requires an information on the position of the print head. Thus, a pin wheel 74 engaging the printed medium is provided on the cartridge. The pin wheel rotates 74 when the cartridge 72 moves along the guide rails 62, 64 and its rotation is detected by means of a motion detector 76. The pin 70 also carries the electrical connections (not shown) to both the print head and the motion detector 76. Pin wheel 74 is used to detect whether or not the printer is sufficiently close to the substrate to print accurately. If the wheel loses contact with the substrate, it stops revolving and the output signal from the motion detector 76 (which can employ a light barrier detecting the pins of the pin wheel 74) changes and printing is interrupted.

The base plate 60, the pins on which the wheels 78 are mounted, and the guide rails 62, 64 are unitary. Thus, the base plate 60 is produced as a unitary unit, e.g., by die casting, in order to simplify construction and minimize component cost. It should be noted that a movement along the direction indicated by the arrow A is not necessary when the cartridge 72 contains a print head having a width sufficient to print the entire image receiving medium in one scan.

Figure 5:
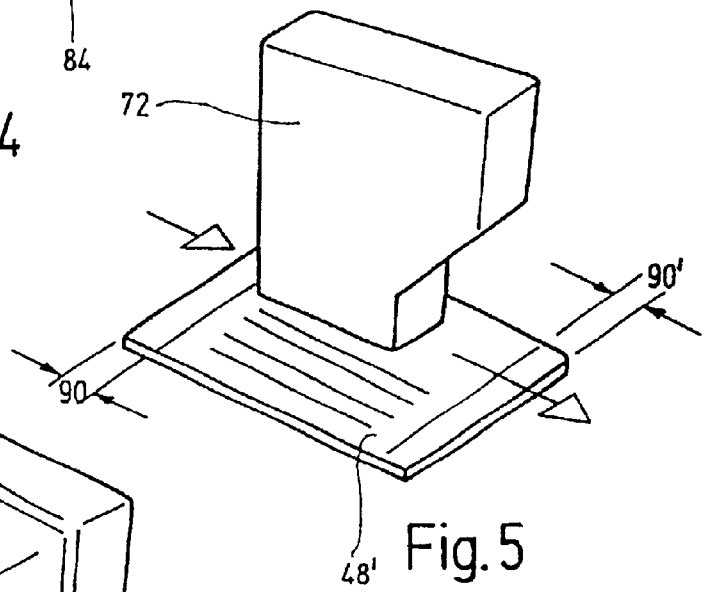
FIG. 5 illustrates the operation mode of the print head.

FIG. 5 illustrates how scanning is performed over the image receiving medium. Most inkjet printers known in the prior art accelerate the print cartridge from rest to normal printing speed prior to firing the ink droplets. This simplifies the control of ink droplet spacing, but the additional space required to accelerate the print cartridge increases the overall size of the product. The printer described here is hand held and thus requires that the overall dimensions be minimized. The control system of the print cartridge 72 thus provides the ability to print as the print cartridge assembly is accelerating—during printing of the left margin 90 of the image receiving medium 48'—and decelerating—during printing of the right margin 90, of the image receiving medium 48'—at the start and finish of each sweep of the mechanism thus enabling the product dimensions to be minimized for a given size of the print area on the image receiving medium.

Figure 6:
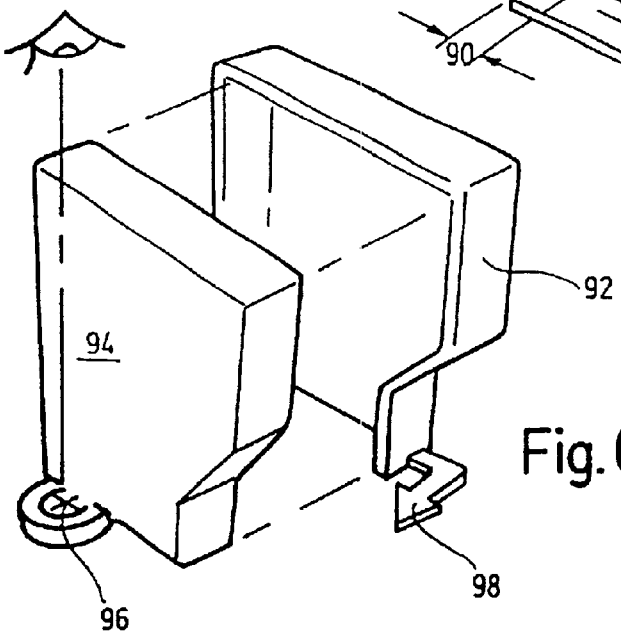
FIG. 6 is a view of a print head with an alignment feature.

In FIG. 6, it is shown how features can be added to the cartridge 94 or the housing 92 of the cartridge 94 (i.e., a holder in which the cartridge is accommodated) to aid alignment of the printer to the print area. These take the form of a pointer 98 or an indicator 96 attached to the print cartridge 94 or to the holder 92. The print cartridge may then be moved around the print area to indicate the maximum printable area.

Figure 7:
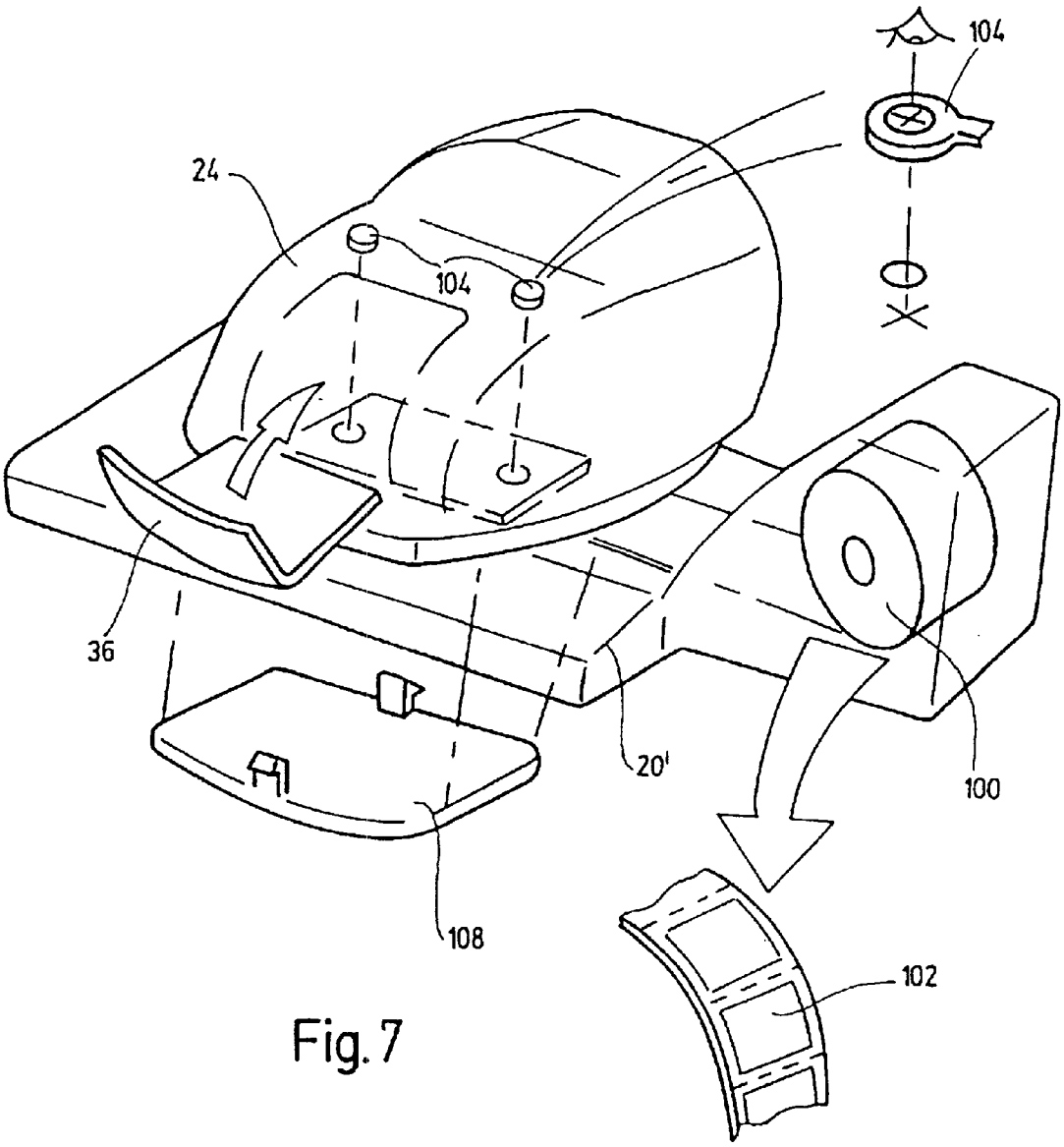
FIG. 7 is a view of the printer mounted on another base station.

FIG. 7 illustrates the printer 24 when placed on an alternative or modified base station 20'. The base station 20' contains a supply 100 of labels 102 for printing upon. In order to prevent the ink cartridge from drying out should the printer 24 not be returned to the base station 24, a sealing lid 108 is attachable to the printer to close the print aperture in the base of the printer. A hermetically sealable compartment is also provided in the base station 20'(not shown). This provides storage for a partially used cartridge to prevent it from drying out, for example, if different color cartridges are used. The printer 24 of FIG. 7 has some features for making alignment on the image receiving medium easier: on the top of the housing of the printer, two small windows 104 are located, which allow viewing of and aligning the image receiving medium with respect to the printer (or the other way around).

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A printer comprising:

a housing;

a scanning mechanism provided in the housing, the scanning mechanism arranged to move within the housing;

a mounting mechanism for mounting an ink jet print head;

the ink jet print head provided with a supply of security ink, wherein said ink jet print head is removably mounted to the mounting mechanism;

an aperture provided within the housing, the aperture arranged to be placed on, or adjacent to, an image receiving medium such that the print head, when mounted, is operable to print onto the image receiving medium through the aperture.

2. A printer according to claim 1, wherein the security ink is of at least one of a:

chemical marker ink;

ink containing a luminescent substance;

UV fluorescent ink;

magnetic ink;

phosphorescent ink; and photo chromic ink.

3. A method of printing security images onto an image receiving medium, comprising the steps of:

providing a printer with a housing and a scanning mechanism in the housing, mounting an ink jet print head provided with an ink supply containing security ink to the scanning mechanism;

providing an aperture within the housing;

placing the aperture on, or adjacent to, the image receiving medium such that the print head can print onto the image receiving medium through the aperture;

scanning the print head with the scanning mechanism within the housing and thereby spitting the security ink according to a desired pattern onto the image receiving medium.

4. A method according to claim 3, wherein the security image is an entry receipt.

5. A method according to claim 3, wherein the security ink is of at least one of a:

chemical marker ink;

ink containing a luminescent substance;

UV fluorescent ink;

magnetic ink;

phosphorescent ink; and photo chromic ink.

6. A printer comprising:

a housing;

a scanning mechanism provided in the housing, the scanning mechanism arranged to move in two different directions within the housing;

a mounting mechanism for releasably mounting an ink jet print head, a holding device, or both to the scanning mechanism, wherein the mounting mechanism is configured and dimensioned to associate with the print head, with the holding device, or with both;

an aperture provided within the housing, the aperture arranged to be positioned on, or adjacent to, an image receiving medium such that the print head, when mounted, is operable to print onto the image receiving medium through the aperture; and the ink jet print head comprising a supply of security ink, the holding device adapted to hold a cutting mechanism, or both, mounted to the mounting mechanism.

7. A printer according to claim 6, wherein the mounted holding device comprises a cutting blade attached thereto.

8. A printer according to claim 6, wherein the mounted holding device comprises a rotating milling cutter attached thereto.

9. A printer according to claim 6, wherein the mounted holding device comprises a rotating drill attached thereto.

10. A printer according to claim 6, in combination with the image receiving medium, wherein the image receiving medium is a stencil material.

11. A printer according to claim 6, further comprising a cutting mechanism, wherein the cutting mechanism comprises a machining device and a rotating mechanism for rotating the machining device.

12. A printer according to claim 6, wherein the holding mechanism instead of the print head is positioned in the mounting mechanism.

13. A printer according to claim 6, wherein both the holding mechanism and the print head are positioned in association with the mounting mechanism.

14. A printer according to claim 6, wherein the holding mechanism instead of the print head is positioned in association with the mounting mechanism and the holding mechanism is provided with a motor for rotating the machining device, the motor being connected to a controlling unit of the printer via a connector to which a print head can be connected.

15. A printer according to claim 6, further comprising a machining device, wherein the machining device is releasably connected to the holding mechanism.

16. A printer comprising:

a housing;

a scanning mechanism provided in the housing, the scanning mechanism arranged to move within the housing;

an ink jet printer head provided with a supply of security ink;

a mounting mechanism for mounting said ink jet print head to the scanning mechanism;

means to detect the motion of the printer relative to an image receiving media;

an aperture provided within the housing, the aperture arranged to be placed on, or adjacent to, the image receiving medium such that the print head, when mounted, is operable to print onto the image receiving medium through the aperture.

17. A hand-held printer cutter device for printing, cutting, or both printing and cutting on an image receiving medium, said printer cutter device comprising:

a housing;

a scanning mechanism provided in the housing, the scanning mechanism arranged to move in two different directions within the housing;

a mounting mechanism attached to the scanning mechanism, the mounting mechanism adapted and configured to associate with and releasably mount a print head, a holding device, or both;

an aperture provided within the housing, the aperture arranged to be positioned on, or adjacent to, the image receiving medium;

means to detect whether or not the printer is sufficiently close to the image receiving medium to print or cut accurately; and at least one of the group consisting of an ink jet print head comprising a supply of security ink, wherein the ink jet print head, when mounted, is operable to print security ink onto the image receiving medium through the aperture, a holding mechanism adapted and configured to hold a cutting mechanism, wherein the held cutting mechanism, when mounted, is operable to at least partially cut the image receiving medium through the aperture, or both the ink jet print head comprising the supply of security ink and the holding mechanism adapted and configured to hold the cutting mechanism.

18. The printer cutter device of claim 17 wherein the mounting mechanism has a surface which is adapted to hold the ink jet print head thereto, and is also adapted to hold the holding mechanism thereto, wherein only one of the ink jet print head and the holding device can be held to the mounting mechanism at any one time, the mounting mechanism further comprising electrical connections for providing electrical power to the held ink jet print head and to the held holding device.

19. The printer cutter device of claim 17 wherein the mounting mechanism has a surface which is adapted to hold the ink jet print head thereto, and is also adapted to hold the holding mechanism thereto, wherein both the ink jet print head and the holding mechanism can be held to the mounting mechanism simultaneously, the mounting mechanism further comprising electrical connections for providing electrical power to the ink jet print head and to the holding mechanism.

20. The printer cutter device of claim 17 wherein the ink jet print head comprising a supply of security ink is mounted to the mounting mechanism.

21. The printer cutter device of claim 17 wherein the holding comprises a cutting mechanism.

* * * * *

UNITED STATES PATENT AND TRADEMARK OFFICE

CERTIFICATE OF CORRECTION

PATENT NO. : 6,499,840 B2
DATED : April 21, 2003
INVENTOR(S) : Day et al.

It is certified that error appears in the above-identified patent and that said Letters Patent is hereby corrected as shown below:

Column 10,
Line 60, after "holding" insert -- mechanism --.

Signed and Sealed this

Twelfth Day of August, 2003

JAMES E. ROGAN
*Director of the United States Patent and Trademark Office*